US010081938B2

(12) United States Patent
Acquistapace et al.

(10) Patent No.: US 10,081,938 B2
(45) Date of Patent: Sep. 25, 2018

(54) MODULAR CONSTRUCTION SYSTEM AND METHOD

(71) Applicants: David T. Acquistapace, Folsom, LA (US); Charles Ryan Acquistapace, Folsom, LA (US)

(72) Inventors: David T. Acquistapace, Folsom, LA (US); Charles Ryan Acquistapace, Folsom, LA (US)

( * ) Notice: Subject to any disclaimer, the term of this patent is extended or adjusted under 35 U.S.C. 154(b) by 0 days.

(21) Appl. No.: 15/344,355

(22) Filed: Nov. 4, 2016

(65) Prior Publication Data

US 2018/0127969 A1 May 10, 2018

(51) Int. Cl.

| | |
|---|---|
| ***E04H 12/00*** | (2006.01) |
| ***E04B 1/26*** | (2006.01) |
| ***E04B 1/41*** | (2006.01) |
| ***E04B 1/19*** | (2006.01) |
| *E04B 1/38* | (2006.01) |

(52) U.S. Cl.

CPC ..... *E04B 1/2608* (2013.01); *E04B 1/1903* (2013.01); *E04B 1/40* (2013.01); *E04B 2001/1918* (2013.01); *E04B 2001/2648* (2013.01); *E04B 2001/405* (2013.01); *E04B 2103/04* (2013.01); *H05K 999/99* (2013.01)

(58) Field of Classification Search

CPC .... E04B 2001/405; E04B 1/2608; E04B 1/40; E04B 1/1903; E04B 2103/04; E04B 2001/1918; E04B 2001/2648

USPC ..... 52/655.1, 653.1, 712

See application file for complete search history.

(56) References Cited

U.S. PATENT DOCUMENTS

| | | | | | |
|---|---|---|---|---|---|
| 1,977,715 | A * | 10/1934 | Coleman | E04C 3/06 | 52/846 |
| 2,675,895 | A * | 4/1954 | Loewenstein | E04B 1/24 | 52/236.3 |
| 3,688,461 | A * | 9/1972 | Rensch | E04B 1/19 | 403/174 |
| 3,999,351 | A * | 12/1976 | Rensch | E04B 1/2403 | 52/280 |
| 4,299,509 | A * | 11/1981 | Meickl | E04B 1/2604 | 403/174 |
| 4,577,449 | A * | 3/1986 | Celli | E04B 1/2403 | 182/186.8 |
| 4,688,358 | A * | 8/1987 | Madray | E04B 1/24 | 403/171 |
| 4,863,305 | A * | 9/1989 | Schold | E04B 1/2604 | 403/171 |
| 5,062,733 | A * | 11/1991 | Cholid | E04B 1/2604 | 403/189 |
| 5,901,523 | A * | 5/1999 | Tasi | A47B 57/54 | 248/223.41 |

(Continued)

*Primary Examiner* — Basil S Katcheves

(74) *Attorney, Agent, or Firm* — AdamsIP, LLC; Stephen Thompson; Gary N. Stewart

(57) ABSTRACT

A system and method for constructing a modular frame structure is provided. The system includes brackets to which structural members can be fastened to form a building frame. Each bracket has between three and six attachment elements positioned at right angles to an adjacent attachment element. A structural member, such as a beam or post, can be fastened to each attachment element to form a moment resisting connection. The brackets are manufactured in standard sizes and configurations so that a set of brackets can be used to construct a modular frame structure of a desired size and configuration.

12 Claims, 9 Drawing Sheets

(56) References Cited

U.S. PATENT DOCUMENTS

| | | | | |
|---|---|---|---|---|
| 6,272,796 | B1 * | 8/2001 | Metzler | E04B 1/28 403/245 |
| 6,802,169 | B2 * | 10/2004 | Simmons | E04B 1/24 403/170 |
| 7,310,920 | B2 * | 12/2007 | Hovey, Jr. | E04B 1/24 52/282.1 |
| 7,823,347 | B1 * | 11/2010 | Blinn | B66C 23/62 182/186.7 |
| 7,823,583 | B2 * | 11/2010 | Allen | F24J 2/16 126/684 |
| 8,863,448 | B2 * | 10/2014 | Werner | F24J 2/14 52/633 |
| 2006/0053726 | A1 * | 3/2006 | Reynolds | E04B 1/19 52/633 |
| 2007/0011983 | A1 * | 1/2007 | Reynolds | E04B 1/19 52/633 |
| 2007/0186503 | A1 * | 8/2007 | Homma | E04B 1/2604 52/655.1 |
| 2010/0050558 | A1 * | 3/2010 | Roberts | E02B 3/04 52/653.2 |
| 2011/0179741 | A1 * | 7/2011 | Yen | E04B 1/34326 52/653.1 |
| 2013/0326993 | A1 * | 12/2013 | Schold | E04B 1/185 52/655.1 |

* cited by examiner

MODULAR CONSTRUCTION SYSTEM AND METHOD

FIELD OF THE INVENTION

A preferred embodiment of the present invention relates generally to a system and method for constructing modular frame structures.

BACKGROUND

Structural members such as wooden beams and posts used in the construction of buildings may be joined in a variety of ways including traditional woodworking joints such as a dovetail joint, a mitre joint, or a dowel joint. In other applications, other devices for joining wooden members may be used including metal connectors, such as 90 degree joints or fasteners such as screws, bolts, or nails. However, such joining devices and methods are typically used on an ad hoc basis for constructing a particular structure and are not particularly suitable for quickly and inexpensively constructing building frames in a modular fashion. In addition, known devices and methods for joining structural members may not be suitable for constructing relatively large modular buildings and may lack the strength necessary for constructing modular building frames for relatively large structures.

Accordingly, a need exists in the art for an improved system and method for quickly and inexpensively constructing high-strength modular frame structures.

SUMMARY

In accordance with the present disclosure, a system and method for constructing modular frame structures used for constructing buildings is provided. The system comprises a plurality of brackets to which structural members can be fastened to form modular frame structures. Each bracket comprises at least three attachment elements extending outward from a node. Each attachment element is positioned at an angle of approximately 90 degrees from an adjacent attachment element. Each attachment element is configured such that a structural member, such as a beam or post, can be fastened to each attachment element to form a moment resisting connection.

Each bracket may comprise between three and six attachment elements depending on the number of structural members forming the connection. The brackets are manufactured in standard sizes and configurations so that a set of brackets can be used to construct a modular frame structure of a desired size and configuration. The frame may be constructed on site or at a construction location and shipped to an installation site. In a preferred embodiment, the structural members used in the construction comprise wood or suitable engineered wood that can be cut into a particular shape for the purpose of fastening the structural member to a bracket.

To construct a frame utilizing a plurality of brackets, a structural member is secured to each attachment element of each bracket so that the structural members are generally at about a 90 degree angle to an adjacent structural member. In a preferred embodiment, each attachment element comprises a plate configured such that the plate can be inserted into a slot in the end of a structural member for fastening the structural member to the plate. For wooden structural members, the ends of the member can be cut to form the slot for inserting the plate. Transverse holes may also be drilled through the structural members in locations corresponding to holes through the plate so that each member can be fastened to a plate using nuts and bolts. In addition, the ends of each structural member may be further cut in a manner such that the members forming a moment connection fit flush with each other. The structural members may be pre-fabricated with the cuts, or cutting may be performed on site during construction.

The type of bracket used at any connection depends on the desired configuration of the frame structure. At corners, a bracket having three attachment elements is utilized, but brackets having up to six attachment elements may be utilized to extend the frame horizontally or vertically for multi-story frames. Thus, rectangular modular frames can be constructed having any number of individual modules in any desired configuration. The proposed system provides a high-strength structural frame that can be constructed quickly and inexpensively by utilizing uniform brackets and structural members.

The foregoing summary has outlined some features of the systems and methods of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purposes of the systems and methods disclosed herein. Those skilled in the pertinent art should also realize that such equivalent designs or modifications do not depart from the scope of the systems and methods of the present disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
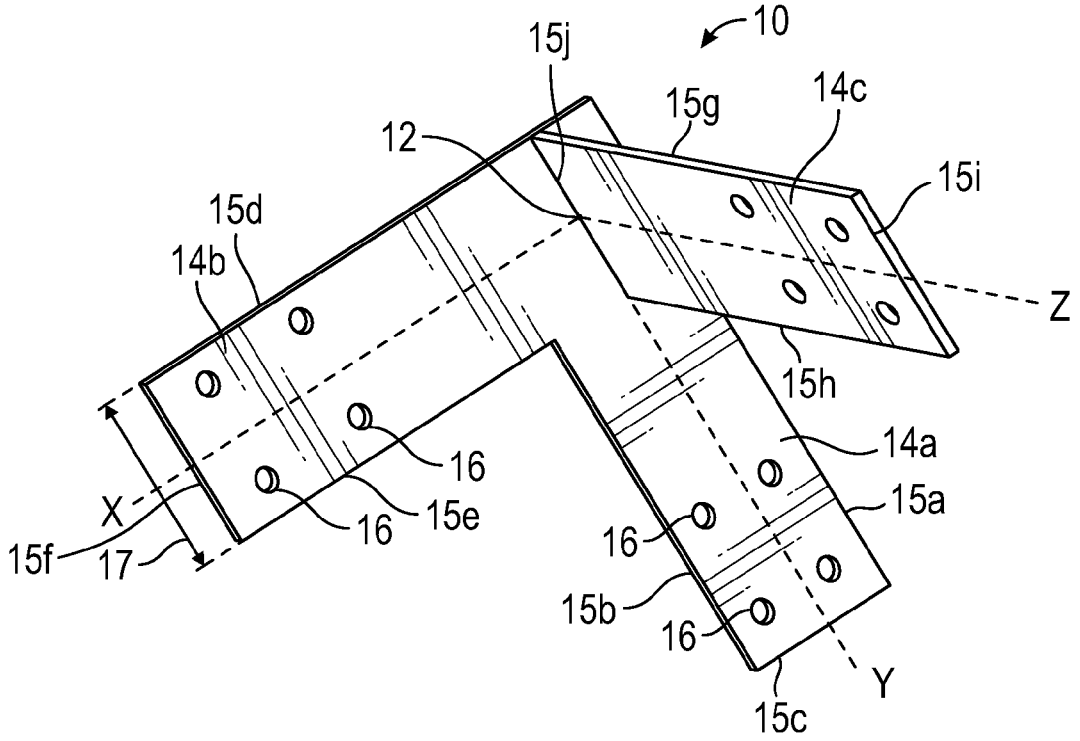
FIG. 1 shows a perspective view of a bracket in accordance with the present disclosure.

FIG. 1 illustrates a bracket 10 that may be utilized in accordance with the present disclosure. The bracket 10 comprises three attachment elements 14 extending outward from a node 12. In a preferred embodiment, as best seen in FIGS. 1 and 2A-2C, each attachment element 14 comprises a plate configured such that the plate can be inserted into a slot 24 in the end of a structural member, such as a beam 20 or a post 22, for fastening the structural member to the plate. Each plate 14 is positioned at an angle of approximately 90 degrees from an adjacent plate 14, as shown in FIG. 1. The bracket 10 shown in FIG. 1 is configured for forming a connection at the corner of a frame structure. Thus, this bracket 10 comprises three plates 14 extending outward along an x-axis, a y-axis, and a z-axis, as illustrated in FIG. 1.

As used herein, reference number 14 refers to attachment elements generally and reference numbers 14*a*-14*f* refer to specific attachment elements illustrated in the drawings. Similarly, as used herein, reference number 20 refers to support beams generally and reference numbers 20*a*-20*e* refer to specific support beams illustrated in the drawings.

Figure 2A:
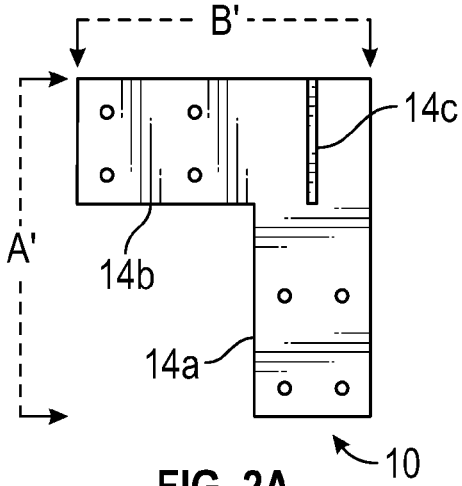
FIG. 2A shows a side elevational view of a bracket in accordance with the present disclosure.
Figure 2B:
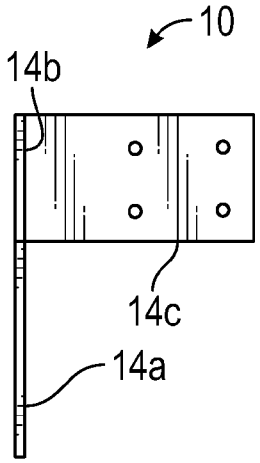
FIG. 2B shows a side elevational view of a bracket in accordance with the present disclosure.
Figure 2C:
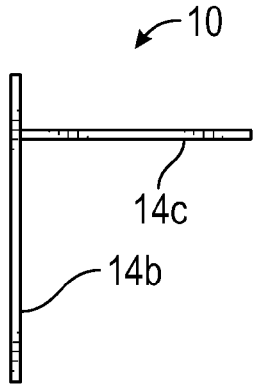
FIG. 2C shows a top plan view of a bracket in accordance with the present disclosure.

FIG. 2A shows a side view of a bracket 10 in accordance with the present disclosure. FIG. 2B shows another side view of the bracket 10 along line A'. FIG. 2C shows a top view of the bracket along line B'.

Figure 3:
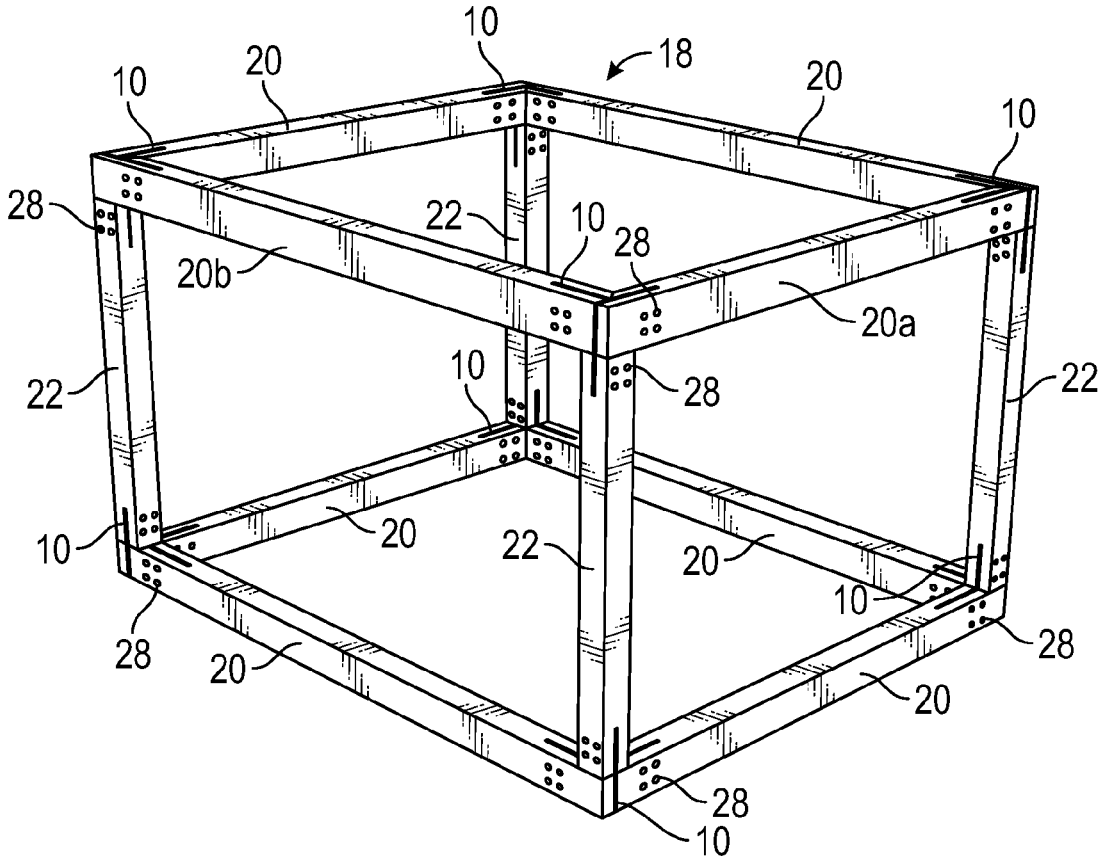
FIG. 3 shows a frame constructed in accordance with the present disclosure.

FIG. 3 shows a single module 18 of a modular frame structure comprising eight brackets 10, eight beams 20, and four posts 22. As discussed in detail below, this module 18 can be expanded to construct larger frame structures by utilizing brackets having additional attachment elements. To construct the module 18 shown in FIG. 3, the beams 20 and posts 22 are secured to each plate 14 of each bracket 10 such that the structural members 20, 22 are generally at about a 90 degree angle to an adjacent structural member 20, 22.

Figure 4A:
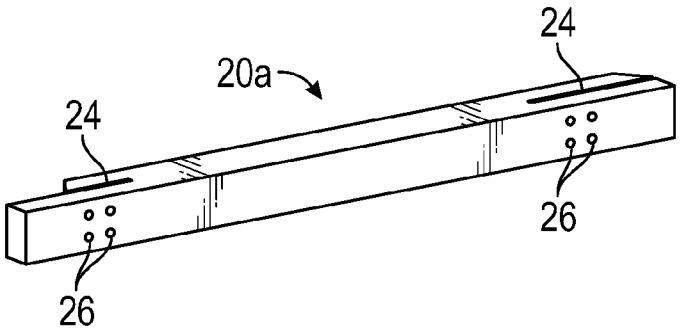
FIG. 4A shows a structural member that may be used to construct a frame in accordance with the present disclosure.
Figure 4B:
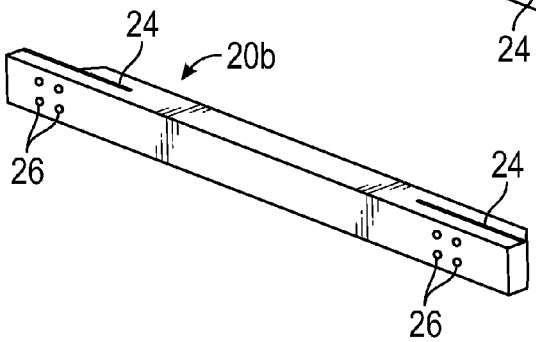
FIG. 4B shows a structural member that may be used to construct a frame in accordance with the present disclosure.
Figure 4C:
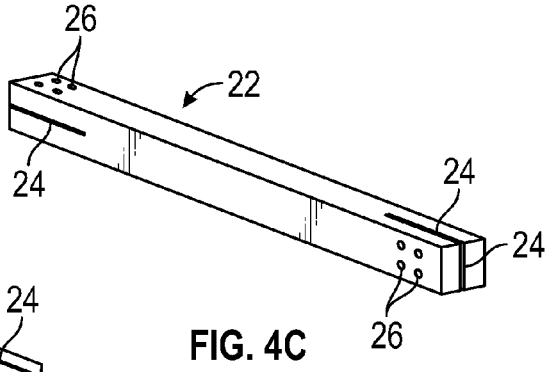
FIG. 4C shows a structural member that may be used to construct a frame in accordance with the present disclosure.

In a preferred embodiment, each of the beams 20 and posts 22 are fastened to a respective plate 14 using nuts and bolts 28, as shown in FIG. 3. FIGS. 4A-4C shows illustrative examples of beams 20 and posts 22 having ends that are compatible with the attachment elements 14 of the brackets 10. Each structural member 20, 22 has a slot 24 at its end such that a plate 14 can be inserted into the slot 24. In addition, each structural member 20, 22 has a set of transverse holes 26 extending through the structural member through which fastening bolts 28 can be inserted. As can be seen in FIGS. 1, 2A, and 2B, each of the plates 14 also has a set of holes 16 extending therethrough. The holes 16 in the plates 14 and the holes 26 in the structural members 20, 22 are configured such that the holes 16 and 26 align when a plate 14 is inserted into a slot 24 in a structural member 20, 22. A bolt 28 can then be inserted through each of the holes 16, 26 and a corresponding nut can be threaded onto the bolt 28 to fasten the structural member 20, 22 to the plate 14, as shown in FIG. 3.

As shown in FIGS. 4A-4C, the ends of the posts 22 and beams 20*a* and 20*b* are preferably shaped differently and are configured such that the ends of the structural members 20*a*, 20*b*, 22 fit flush with each other when the members are fastened to the brackets 10, as shown in FIG. 3. In a preferred embodiment, the structural members 20*a*, 20*b*, 22 comprise wood such as treated timber or suitable engineered wood. The wooden beams 20 and posts 22 can be cut for the purpose of forming the slots 24 for inserting the plates 14 and for forming the ends into shapes that fit flush with other members. Cuts to the wood of the structural members 20*a*, 20*b*, 22 to form the slots 24 and the shapes of the ends may be made on site during construction of the frame structure using suitable saws or similar cutting devices. In addition, holes 26 through the members may be drilled on site during construction. Alternatively, the structural members 20*a*, 20*b*, 22 may be pre-fabricated in a desired shape, which may include pre-drilled holes 26 for fastening with bolts 28.

In a preferred embodiment, the ends of the structural members 20*a*, 20*b*, 22 are cut in the shapes shown in FIGS. 3 and 4A-4C. For instance, as shown in FIG. 4C, each of the posts 22 preferably has a generally flat end with a slot 24 cut into the end of the post 22. The orientation of the slots 24 is rotated at opposing ends of the post 22 by 90 degrees such that a plate 14 can be inserted into each of the slots 24 for fastening the post 22 to the plate 14. FIGS. 4A and 4B illustrate beams 20*a* and 20*b* shown in FIG. 3. As seen in FIGS. 4A and 4B, beams 20*a* and 20*b* have opposing ends of different shapes configured so that the beams 20*a* and 20*b* fit flush with each other when fastened to a brackets 10 as shown in FIG. 3. The shapes illustrated in FIG. 4 are a preferred embodiment only and may be configured differently in alternative embodiments, such as embodiments in which a bracket 10 comprises more than three attachment elements 14, as discussed below.

In a preferred embodiment, the brackets 10 are constructed of galvanized steel and comprise plates 14 that are approximately one-half inch thick. The beams 20 and posts 22 preferably have a rectangular or square cross-sectional area. In addition, the beams 20 and posts 22 are preferably about 8 inches to about 12 inches in diameter and range in length from about 16 feet to about 24 feet, though other dimensions are possible. Each plate 14 preferably has a width 17 approximately equal to the diameter of the structural member 20, 22 fastened to the plate 14 so that the edges of the plate 14 are generally flush with the exterior of the structural member 20, 22, as shown in FIG. 3.

Once the module 18 has been constructed as shown in FIG. 3, a heavy-frame structure is provided that may be used as a support structure for buildings of various types by installing additional structural elements. For instance, other structural elements may be secured to the frame, including, but not limited to, joists for roofing or flooring, interior and exterior non-bearing walls, studs, and lintels.

Figure 5A:
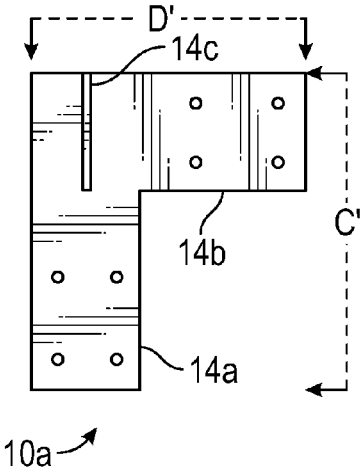
FIG. 5A shows a side elevational view of a bracket in accordance with the present disclosure.
Figure 5B:
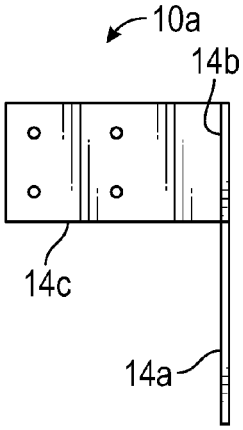
FIG. 5B shows a side elevational view of a bracket in accordance with the present disclosure.
Figure 5C:
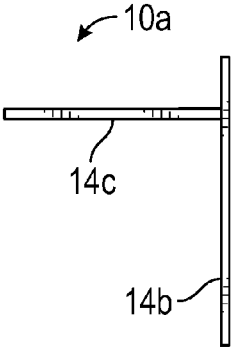
FIG. 5C shows a top plan view of a bracket in accordance with the present disclosure.

In another aspect, a bracket system for constructing a modular frame structure is provided. The system comprises a plurality of brackets 10 for forming moment resisting connections between structural members 20, 22. In a preferred embodiment, a portion of the brackets are three-dimensional mirror images of the remaining brackets. FIGS. 5A-5C illustrate a bracket 10*a* that is a three-dimensional mirror image of the bracket 10 shown in FIGS. 2A-2C. FIG. 5A shows a side view of a bracket 10*a* in accordance with the present disclosure. FIG. 5B shows another side view of the bracket 10*a* along line C'. FIG. 5C shows a top view of the bracket along line D'. As shown in FIGS. 5A-5C, attachment elements 14*a* and 14*b* form a generally flat, L-shaped plate with attachment element 14*c* extending outwardly from the plate at approximately right angles to both attachments elements 14*a* and 14*b* . As shown in FIG. 1 , attachment element 14*a* has a first straight edge 15*a* , a second straight edge 15*b* , and a third straight edge 15*c* . Attachment element 14*b* has a fourth straight edge 15*d* , a fifth straight edge 15*e* , and a sixth straight edge 15*f* , as further shown in FIG. 1. Attachment element 14*c* has a seventh straight edge 15*g* , an eighth straight edge 15*h* , a ninth straight edge 15*i* , and a tenth straight edge 15*j* , as further shown in FIG. 1. The bracket 10*a* can be produced by welding attachment element 14*c* onto the opposite side of bracket 10 shown in FIGS. 2A- 2C. Alternatively, the bracket 10*a* can be produced by rotating attachment element 14*c* by 90 degrees before attaching to the same side of bracket 10.

Figure 6:
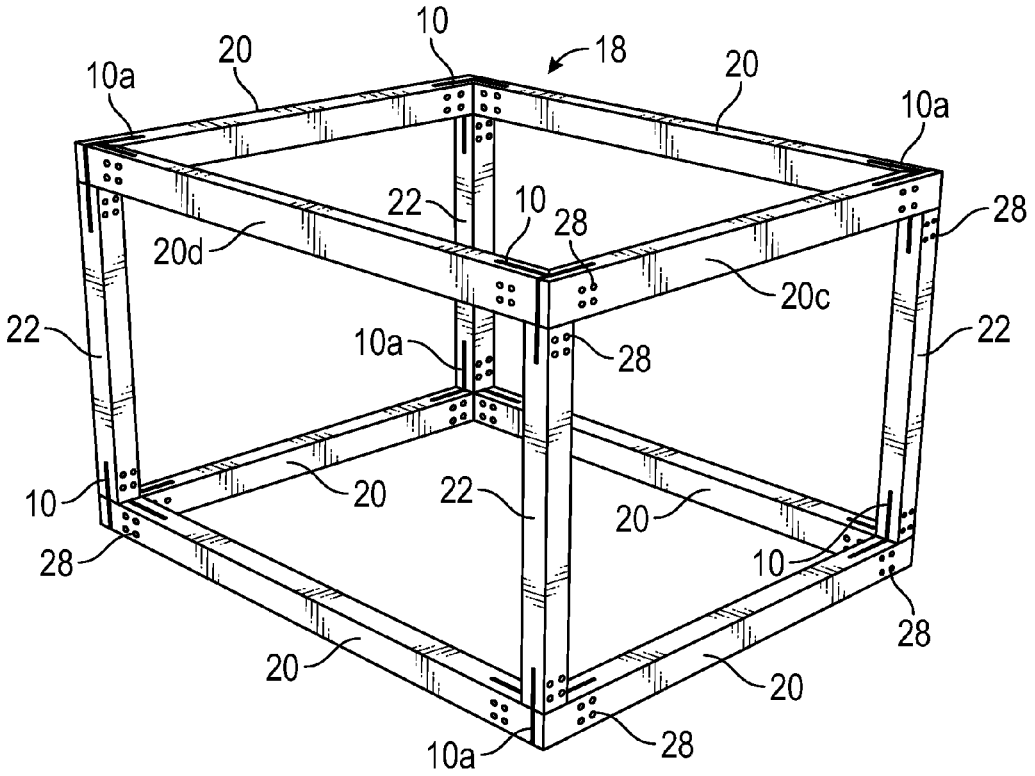
FIG. 6 shows a frame constructed in accordance with the present disclosure.

FIG. 6 shows a single module 18 of a modular frame structure constructed using a plurality of brackets 10 and mirror-image brackets 10*a*. In a preferred embodiment, mirror-image brackets may be utilized for aesthetic purposes so that the finished frame structure appears symmetrical with the slots 24 in the posts 22 being on the same side of the frame module 18, as shown in FIG. 6. Thus, the slots 24 at opposing ends of the posts 22 are oriented in the same configuration at both ends, as can be seen in FIG. 6. In addition, the opposing ends of each beam 20 have the same shape at both ends, though the shapes of the ends differ from those of adjacent beams 20, as can be seen in beams 20*c* and 20*d* in FIG. 6.

Figure 7A:
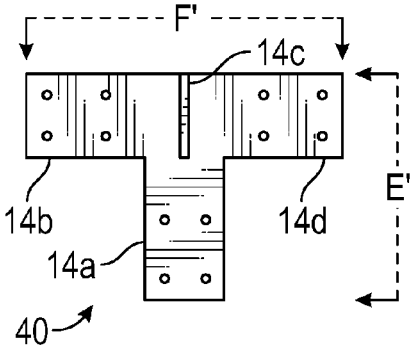
FIG. 7A shows a side elevational view of a bracket in accordance with the present disclosure.
Figure 7B:
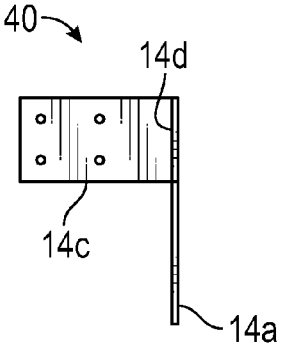
FIG. 7B shows a side elevational view of a bracket in accordance with the present disclosure.
Figure 7C:
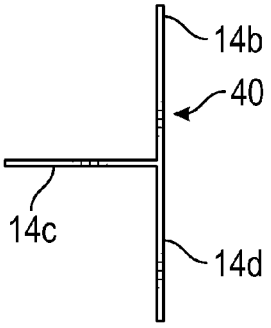
FIG. 7C shows a top plan view of a bracket in accordance with the present disclosure.

The module 18 shown in FIGS. 3 and 6 utilizes brackets 10, 10*a* having three attachment elements 14 for connections at corners of the frame. In other embodiments, brackets having up to six attachment elements may be utilized to extend the frame horizontally or vertically for multi-story frames. FIGS. 7A-7C illustrate a bracket 40 having four attachment elements, wherein each attachment element comprises a plate 14 for fastening a structural member 20, 22 to the plate 14.

FIG. 7A shows a side view of the bracket 40 with attachment element 14*c* extending outward at an approximately right angle from a generally flat, T-shaped plate formed by attachment elements 14*a*, 14*b*, and 14*d*. FIG. 7B shows another side view of the bracket 40 along line E'. FIG. 7C shows a top view of the bracket 40 along line F'.

Figure 8:
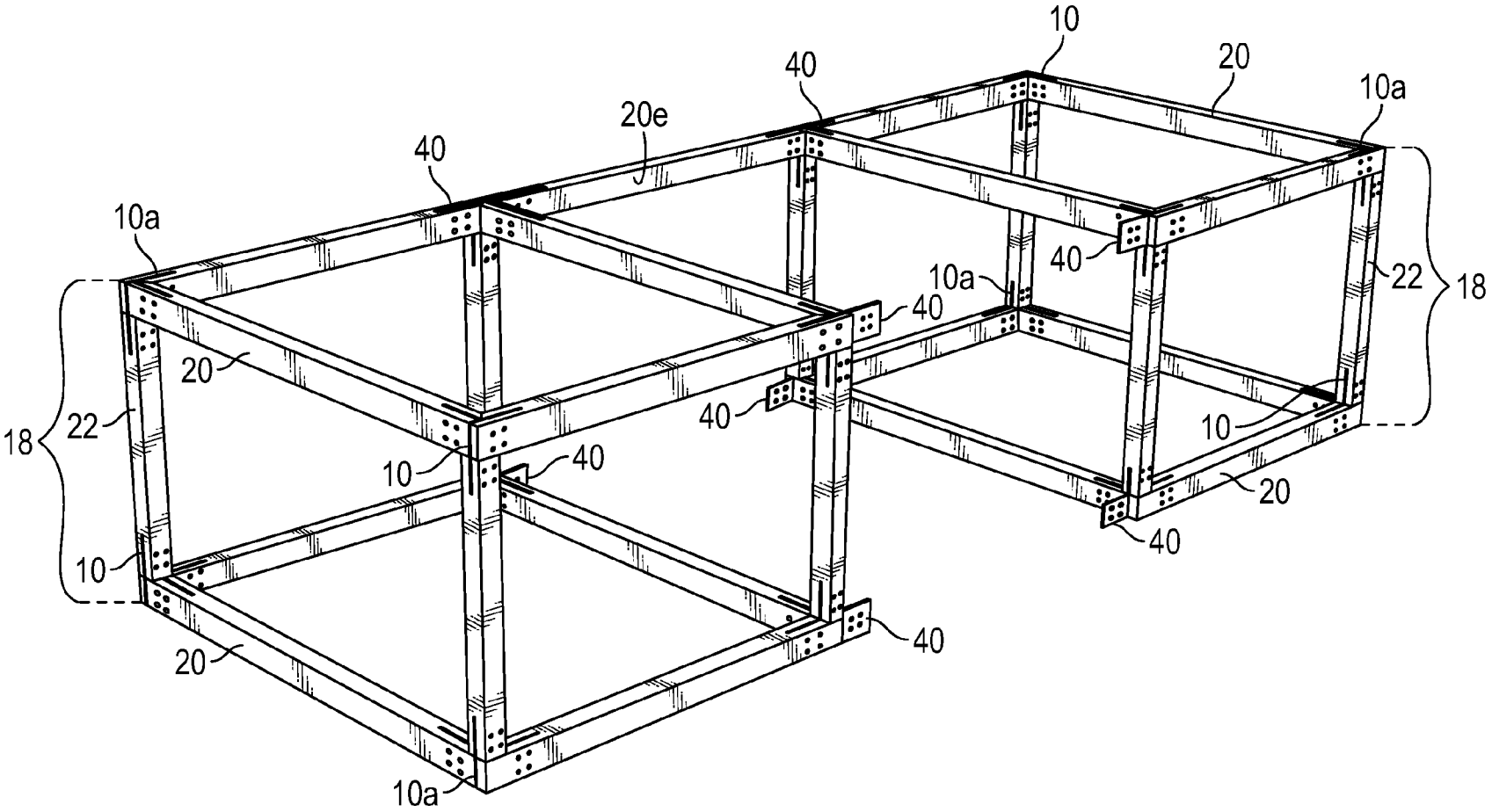
FIG. 8 shows a frame constructed in accordance with the present disclosure.

FIG. 8 illustrates a frame structure comprising multiple modules 18 constructed utilizing brackets 10, 10*a* having three attachment elements 14 at the corners of the frame and brackets 40 having four attachment elements 14 at the interior moment connections. Interior support beams 20*e* may have a generally flat ends at one or both ends of the beam 20*e* with slots 24 cut into the end for fastening to an attachment element 14. As shown in FIG. 8, the brackets 40 with four attachment elements 14 are used to extend the frame structure horizontally in one direction. Alternatively, brackets 40 with four attachment elements 14 may also be used to extend the structure vertically. Some beams have been omitted from the frame shown in FIG. 8 for ease of illustrating the configuration of some brackets used in construction of the frame.

Figure 9A:
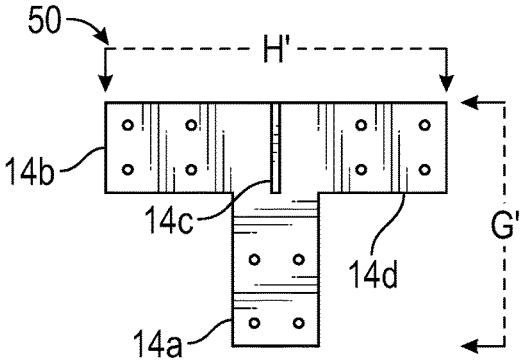
FIG. 9A shows a side elevational view of a bracket in accordance with the present disclosure.
Figure 9B:
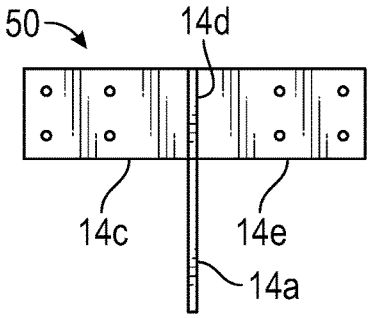
FIG. 9B shows a side elevational view of a bracket in accordance with the present disclosure.
Figure 9C:
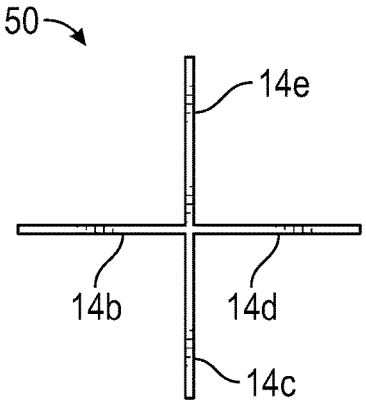
FIG. 9C shows a top plan view of a bracket in accordance with the present disclosure.

FIGS. 9A-9C illustrate a bracket 50 having five attachment elements, which may be used to extend the frame structure in two directions, such as a one-story structure extended horizontally in two directions or a multi-story structure also extended horizontally in one direction. FIG. 9A shows a side view of the bracket 50 with attachment element 14*c* extending outward at an approximately right angle from a generally flat, T-shaped plate formed by attachment elements 14*a*, 14*b*, and 14*d*, with attachment element 14*e* extending outward from the T-shaped plate on the opposite side of the plate from attachment element 14*c*. Attachment element 14*e* can be seen in FIGS. 9B and 9C. FIG. 9B shows another side view of the bracket 50 along line G'. FIG. 9C shows a top view of the bracket 50 along line H'.

Figure 10A:
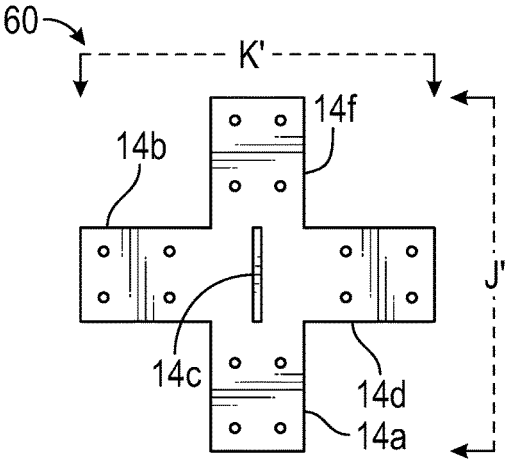
FIG. 10A shows a side elevational view of a bracket in accordance with the present disclosure.
Figure 10B:
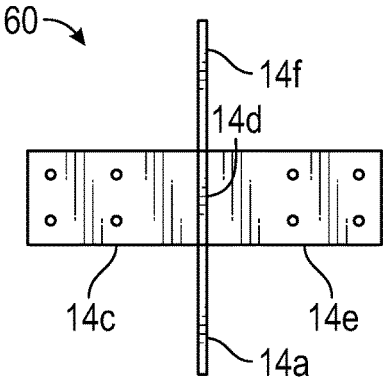
FIG. 10B shows a side elevational view of a bracket in accordance with the present disclosure.
Figure 10C:
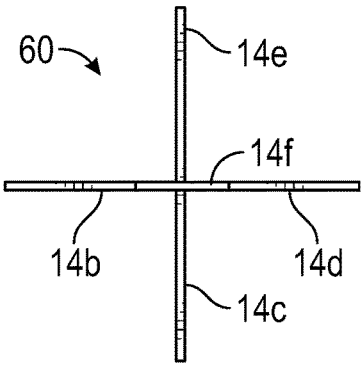
FIG. 10C shows a top plan view of a bracket in accordance with the present disclosure.

FIGS. 10A-10C illustrate a bracket 60 having six attachment elements, which may be used to extend the frame structure in three directions to construct multi-story frames also extended horizontally in two directions. FIG. 10A shows a side view of the bracket 60 with attachment element 14*c* extending outward at an approximately right angle from a generally flat, X-shaped plate formed by attachment elements 14*a*, 14*b*, 14*d*, and 14*f*, with attachment element 14*e* extending outward from the X-shaped plate on the opposite side from attachment element 14*c*. FIG. 10B shows another side view of the bracket 60 along line J'. FIG. 10C shows a top view of the bracket 60 along line K'.

Figure 11:
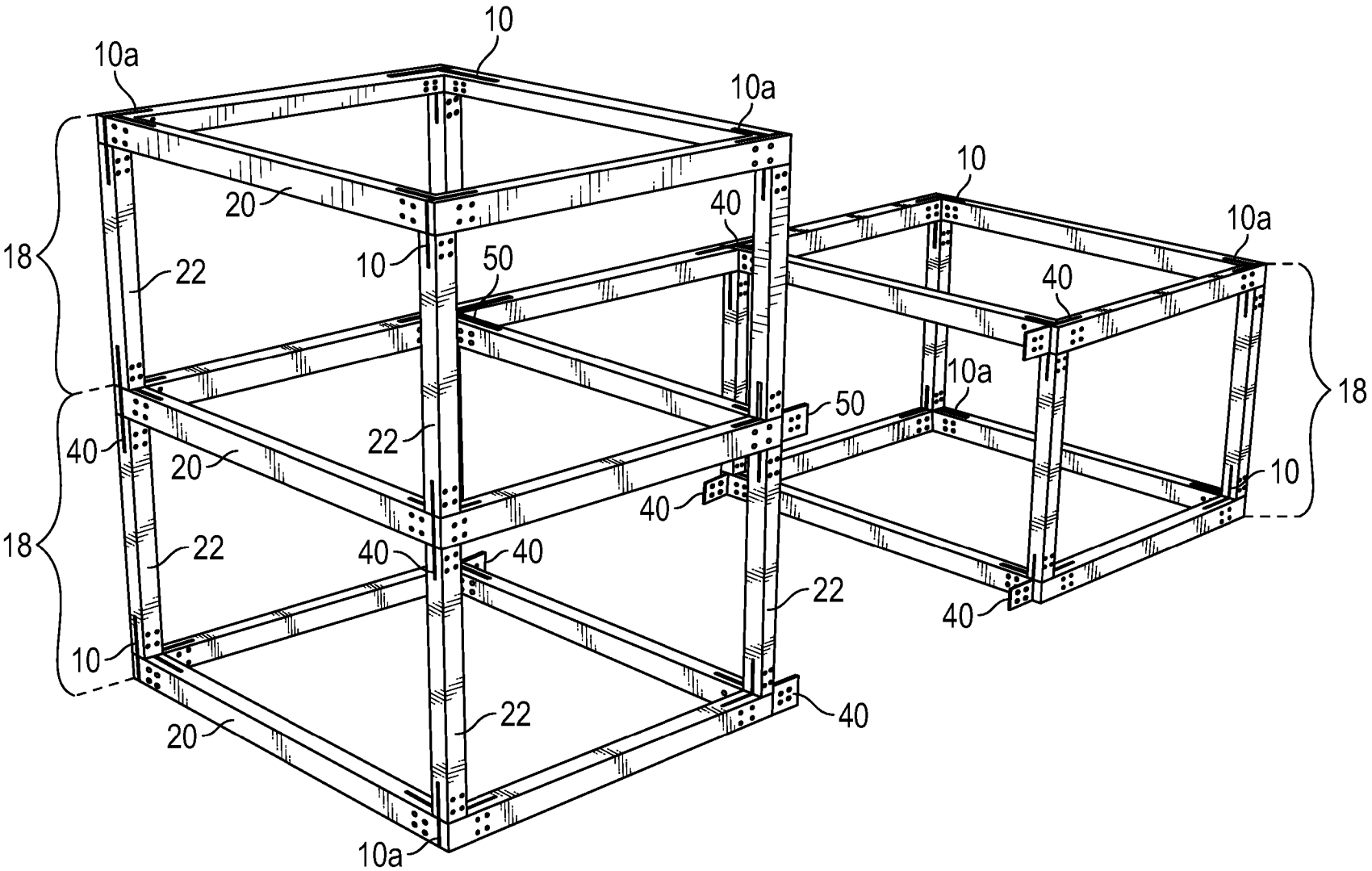
FIG. 11 shows a frame constructed in accordance with the present disclosure.

FIG. 11 illustrates a frame structure comprising multiple modules 18 constructed utilizing brackets 10, 10*a* having three attachment elements 14 at the corners of the frame, brackets 40 having four attachment elements 14 at connections extending the frame vertically to form a second story of the frame, and brackets 50 having five attachment elements 14 at connections extending the frame both vertically and horizontally. Some beams have been omitted from the frame shown in FIG. 8 for ease of illustrating the configuration of some brackets used in construction of the frame. Brackets 60 having six attachment elements 14 could also be used to extend the frame shown in FIG. 11 horizontally in a second direction.

Figure 12A:
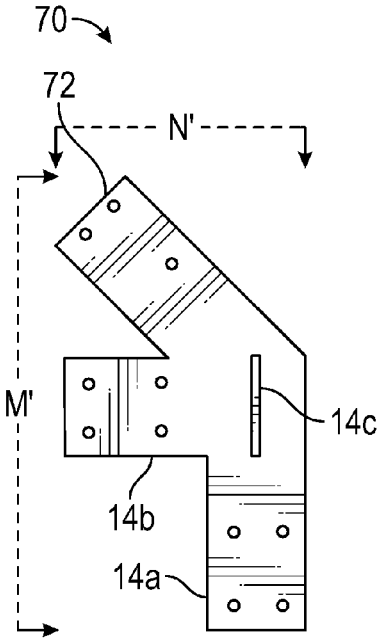
FIG. 12A shows a side elevational view of a bracket in accordance with the present disclosure.
Figure 12B:
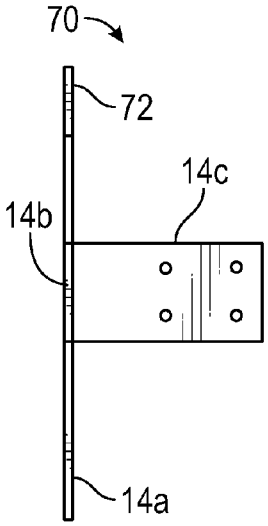
FIG. 12B shows a side elevational view of a bracket in accordance with the present disclosure.
Figure 12C:
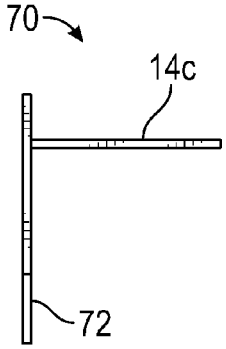
FIG. 12C shows a top plan view of a bracket in accordance with the present disclosure.

In one embodiment, as shown in FIGS. 12A-12C, a bracket 70 comprises three attachment elements 14 each positioned at an angle of approximately 90 degrees from an adjacent attachment element 14 and an angular attachment element 72 positioned at an acute angle to an adjacent attachment element 14. The acute angle is preferably in the range of about 40 to 50 degrees. The angular attachment element 72 is used to fasten a rafter 74 or similar type of sloped structural member for supporting a roof. FIG. 12A shows a side view of the bracket 70 with attachment element 72 positioned at an angle of about 45 degrees to attachment element 14*b*. FIG. 12B shows another side view of the bracket 70 along line M'. FIG. 12C shows a top view of the bracket 70 along line N'.

Figure 13A:
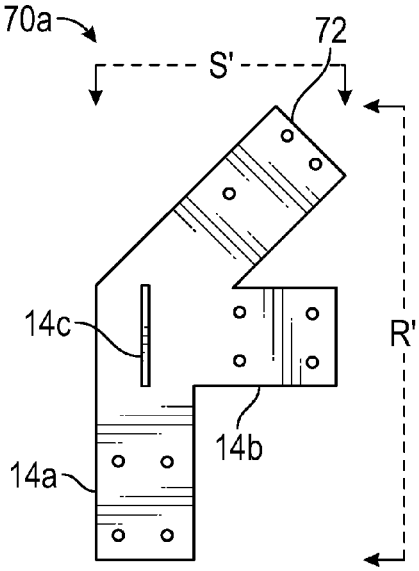
FIG. 13A shows a side elevational view of a bracket in accordance with the present disclosure.
Figure 13B:
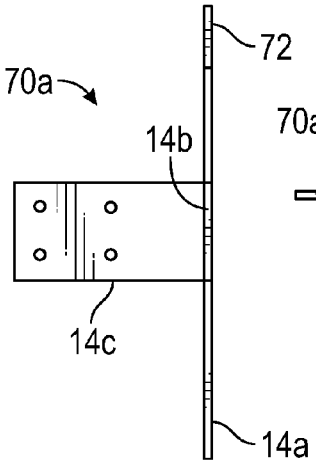
FIG. 13B shows a side elevational view of a bracket in accordance with the present disclosure.
Figure 13C:
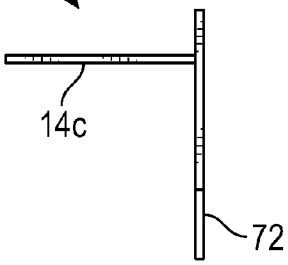
FIG. 13C shows a top plan view of a bracket in accordance with the present disclosure.

FIGS. 13A-13C illustrate a bracket 70*a* that is a three-dimensional mirror image of the bracket 70 shown in FIGS. 12A-12C. FIG. 13A shows a side view of a bracket 70*a*. FIG. 13B shows another side view of the bracket 70*a* along line R'. FIG. 13C shows a top view of the bracket along line S'. The bracket 70*a* can be produced by welding attachment element 14*c* onto the opposite side of bracket 70 shown in FIGS. 12A-12C.

Figure 14:
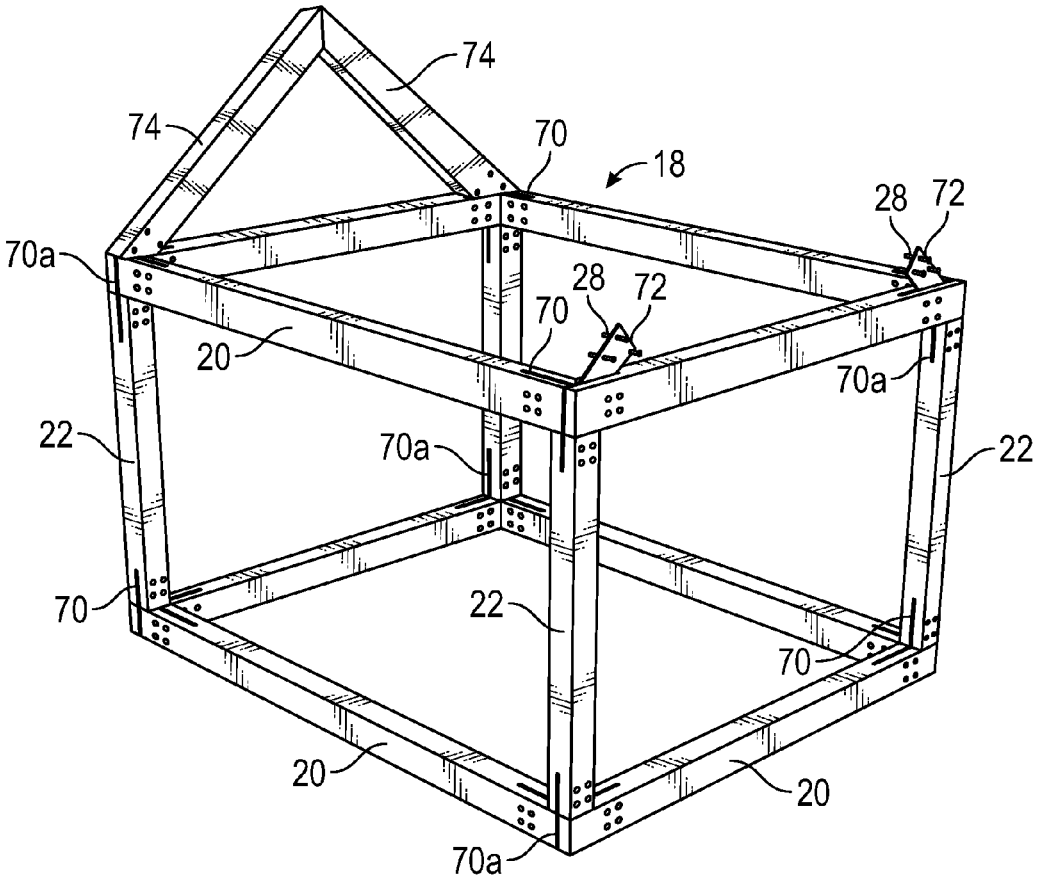
FIG. 14 shows a frame constructed in accordance with the present disclosure.

FIG. 14 shows a single module 18 of a modular frame structure constructed using a plurality of brackets 70 and mirror-image brackets 70*a*, support beams 20, posts 22, and rafters 74 for supporting a sloped roof. Rafters have been omitted from one side of the frame for ease of illustrating the angled attachment elements 72. In another embodiment, the brackets 70, 70*a* shown in FIGS. 12A-12C and 13A-13C may comprise four attachment elements 14 positioned at right angles such that the module 18 can be extended horizontally and include interior rafters in the frame.

Figure 15:
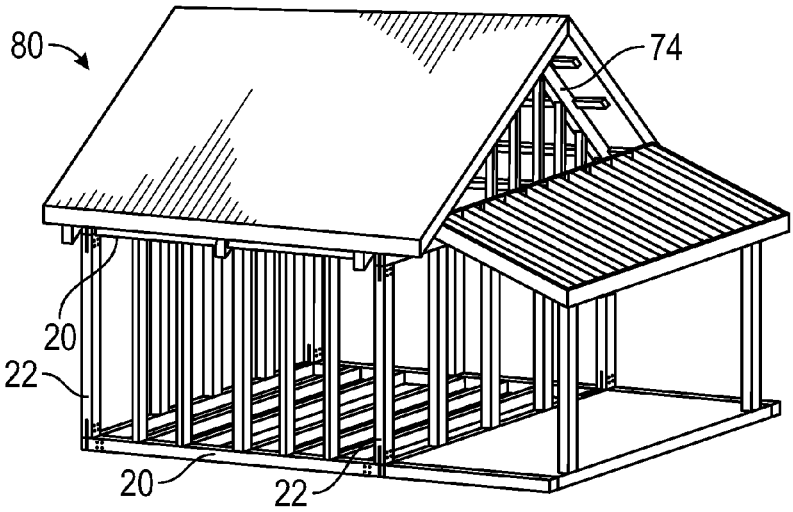
FIG. 15 shows a building comprising a frame constructed in accordance with the present disclosure.

FIG. 15 illustrates an example building that may be constructed using the frame 18 shown in FIG. 14. The module 18 provides a heavy-frame structure that may be used as a support structure for the building. Additional structural elements may be secured to the frame as shown in FIG. 15, including, but not limited to, joists for roofing or flooring, roofing and flooring material, interior and exterior non-bearing walls, studs, and lintels.

The brackets 10, 10*a*, 40, 50, 60, 70, 70*a* described herein are manufactured in standard sizes and configurations so that a set of brackets can be used to construct a modular frame structure of a desired size and configuration. The frame may be constructed on site or at a construction location and shipped to an installation site. The frame may be attached to a slab or similar type of foundation, or may be a free-standing structure.

The type of bracket used at any connection depends on the desired configuration of the frame structure. At corners, a bracket 10, 10*a* having three attachment elements 14 is utilized, but brackets 40, 50, 60 having up to six attachment elements 14 may be utilized to extend the frame horizontally or vertically for multi-story frames. Thus, rectangular modular frames can be constructed having any number of individual modules in any desired configuration. Alternatively, brackets 70, 70*a* utilizing angled attachment elements 72 may be used to provide support for sloped roofing. The proposed system provides a high-strength structural frame that can be constructed quickly and inexpensively by utilizing uniform brackets and structural members.

In alternative embodiments, attachment elements 14*c* and, if applicable, 14*e* may be attached to any of the brackets 10, 10*a*, 40, 50, 60, 70, 70*a* in a position in which one or both are rotated by 90 degrees provided that the cuts made to the attached support beams 20 are compatible with the attachment elements as configured. In addition, an alternatively configured bracket having five attachment elements 14 may be produced by removing attachment element 14*e* from the bracket 60 as shown in FIGS. 10A-10C.

It is understood that versions of the invention may come in different forms and embodiments. Additionally, it is understood that one of skill in the art would appreciate these various forms and embodiments as falling within the scope of the present disclosure.

What is claimed is:

1. A system for constructing a modular frame structure, said system comprising:

a plurality of brackets, wherein each bracket comprises at least three attachment elements including a first attachment element, a second attachment element, and a third attachment element, wherein the first attachment element and the second attachment element collectively form an L-shaped plate having a first perimeter defined by a first plurality of straight edges, the third attachment element having a second perimeter defined by a second plurality of straight edges, wherein the third attachment element is secured perpendicularly to the L-shaped plate within the first perimeter, wherein each of the at least three attachment elements extend outward from a node such that each attachment element is positioned at an angle of approximately 90 degrees from an adjacent attachment element, and wherein the plurality of brackets comprise a first set of brackets and a second set of brackets, wherein the first set of brackets are three-dimensional mirror images of the second set of brackets; and a plurality of structural members, wherein each structural member of the plurality of structural members has a first end having a first slot configured to receive an attachment element of a bracket from the first set of brackets and a second opposing end configured to receive an attachment element of a bracket from the second set of brackets, and wherein the width of each attachment element is equal to the diameter of at least one of the first end and the second end of a structural member from the plurality of structural members.

2. The system of claim 1, wherein at least one bracket within the plurality of brackets further comprises an angular attachment element positioned at an acute angle to one of the at least three attachment elements of the at least one bracket.

3. The system of claim 1, wherein the first attachment element has a first straight edge, a second straight edge parallel to the first straight edge, and a third straight edge perpendicularly meeting both the first straight edge and the second straight edge, wherein the second attachment has a fourth straight edge, a fifth straight edge parallel to the fourth straight edge, and a sixth straight edge perpendicularly meeting both the fourth straight edge and the fifth straight edge, wherein the first straight edge perpendicularly meets with the fourth straight edge and the second straight edge perpendicularly meets with the fifth straight edge, wherein the first straight edge, the second straight edge, the third straight edge, the fourth straight edge, the fifth straight edge, and the sixth straight edge collectively define the first plurality of straight edges, the third attachment element having a seventh straight edge, an eighth straight edge parallel to the seventh straight edge, a ninth straight edge perpendicularly meeting both the seventh straight edge and the eighth straight edge, and a tenth straight edge perpendicularly meeting both the seventh straight edge and the eighth straight edge, wherein the seventh straight edge, the eighth straight edge, the ninth straight edge, and the tenth straight edge collectively define the second plurality of straight edges, wherein the tenth straight edge is secured to the L-shaped plate adjacent to the seventh straight edge such that the eighth straight edge is in line with the fifth straight edge and the seventh straight edge perpendicularly meets the fourth straight edge.

4. The system of claim 3, wherein each attachment element comprises a plate, wherein each plate has a plurality of holes extending therethrough.

5. The system of claim 4, further comprising a plurality of bolts and a plurality of corresponding nuts for bolting a structural member to each plate.

6. The system of claim 4, wherein at least one bracket within the plurality of brackets further comprises an angular attachment element positioned at an acute angle to one of the at least three attachment elements of the at least one bracket.

7. A system for constructing a modular frame structure, the system comprising:

a plurality of brackets, wherein each bracket of the plurality of brackets comprises at least three attachment elements including a first attachment element, a second attachment element, and a third attachment element, wherein the first attachment element and the second attachment element collectively form an L-shaped plate having a first perimeter defined by a first plurality of straight edges, the third attachment element having a second perimeter defined by a second plurality of straight edges, wherein the third attachment element is secured perpendicularly to the L-shaped plate within the first perimeter, and wherein each of the at least three attachment elements extend outward from a node such that each attachment element is positioned at an angle of approximately 90degrees from an adjacent attachment element; and a first plurality of securing members, each securing member of the first plurality of securing members has a first end having a first slot and a second end having a second slot, the orientation of the first slot being rotated 90 degrees from the orientation of the second slot; and a second plurality of securing members, each securing member of the second plurality of securing members has a third end with a third slot and a fourth end having a fourth slot, wherein the first slot, the second slot, the third slot, and the fourth slot are each configured to receive an attachment element therein.

8. The system of claim 7, wherein the width of each attachment element is equal to the dimeter of at least one of the first end, the second end, the third end, and the fourth end.

9. The system of claim 7, wherein the third end is shaped differently from the fourth end.

10. The system of claim 7, wherein each attachment element comprises a plate having a first plurality of holes extending therethrough, and wherein the first end, the second end, the third end, and the fourth end each have a second plurality of holes extending therethrough.

11. The system of claim 7, wherein at least one bracket within the plurality of brackets further comprises an angular attachment element positioned at an acute angle to one of the at least three attachment elements of the at least one bracket.

12. The system of claim 7, wherein the first attachment element has a first straight edge, a second straight edge parallel to the first straight edge, and a third straight edge perpendicularly meeting both the first straight edge and the second straight edge, wherein the second attachment has a fourth straight edge, a fifth straight edge parallel to the fourth straight edge, and a sixth straight edge perpendicularly meeting both the fourth straight edge and the fifth straight edge, wherein the first straight edge perpendicularly meets with the fourth straight edge and the second straight edge perpendicularly meets with the fifth straight edge, wherein the first straight edge, the second straight edge, the third straight edge, the fourth straight edge, the fifth straight edge, and the sixth straight edge collectively define the first plurality of straight edges, the third attachment element having a seventh straight edge, an eighth straight edge parallel to the seventh straight edge, a ninth straight edge perpendicularly meeting both the seventh straight edge and the eighth straight edge, and a tenth straight edge perpendicularly meeting both the seventh straight edge and the eighth straight edge, wherein the seventh straight edge, the eighth straight edge, the ninth straight edge, and the tenth straight edge collectively define the second plurality of straight edges, wherein the tenth straight edge is secured to the L-shaped plate adjacent to the seventh straight edge such that the eighth straight edge is in line with the fifth straight edge and the seventh straight edge perpendicularly meets the fourth straight edge.

* * * * *